United States Patent [19]

Kaspar

[11] 4,428,096

[45] Jan. 31, 1984

[54] HOLD-OPEN MECHANISM FOR REFRIGERATED DISPLAY CABINET HAVING COOPERATING SPRING AND LOBED PLATE

[75] Inventor: Melvin C. Kaspar, La Grange Park, Ill.

[73] Assignee: Ardco, Inc., Chicago, Ill.

[21] Appl. No.: 306,145

[22] Filed: Sep. 28, 1981

[51] Int. Cl.[3] ..... E05D 11/10

[52] U.S. Cl. ..... 16/335; 16/347; 16/374; 267/158; 292/76

[58] Field of Search ..... 16/292, 296, 297, 317, 16/335, 337, 341, 343, 347, 374; 292/17, 76; 267/158

[56] References Cited

U.S. PATENT DOCUMENTS

| | | | |
|---|---|---|---|
| 2,513,751 | 7/1950 | Semar . | |
| 2,712,149 | 7/1955 | Harms . | |
| 2,947,023 | 8/1960 | Hollar, Jr. | 16/335 |
| 2,987,782 | 6/1961 | Kurowski | 292/265 X |
| 3,070,829 | 1/1963 | Peras . | |
| 3,131,421 | 5/1964 | Kurowski | 16/262 X |
| 3,710,417 | 1/1973 | Berman et al. | 16/335 X |
| 3,911,529 | 10/1975 | Pringle | 16/335 |
| 4,177,540 | 12/1979 | Gorton | 16/335 |
| 4,329,759 | 5/1982 | Lautenschläger | 16/335 |

FOREIGN PATENT DOCUMENTS

| | | | |
|---|---|---|---|
| 2524454 | 12/1976 | Fed. Rep. of Germany | 16/335 |

*Primary Examiner*—Fred A. Silverberg

*Attorney, Agent, or Firm*—Dressler, Goldsmith, Shore, Sutker & Milnamow, Ltd.

[57] ABSTRACT

A hold-open mechanism is disclosed which is particularly suitable for use on a self-closing door assembly for a refrigerated display cabinet. The hold-open mechanism includes a stop plate carried by the hinged door, and a hold-open spring mounted on the door frame which supports the door. In one embodiment, the hold-open spring is selectively positionable so as to accommodate normal swinging movement of the door in one position, and is adapted to releasably engage and retain the stop plate on the door in a second position so that the door is maintained opened. In another embodiment, the hold-open mechanism automatically operates to releasably retain the door in its fully opened position whenever the door is moved to that position.

8 Claims, 9 Drawing Figures

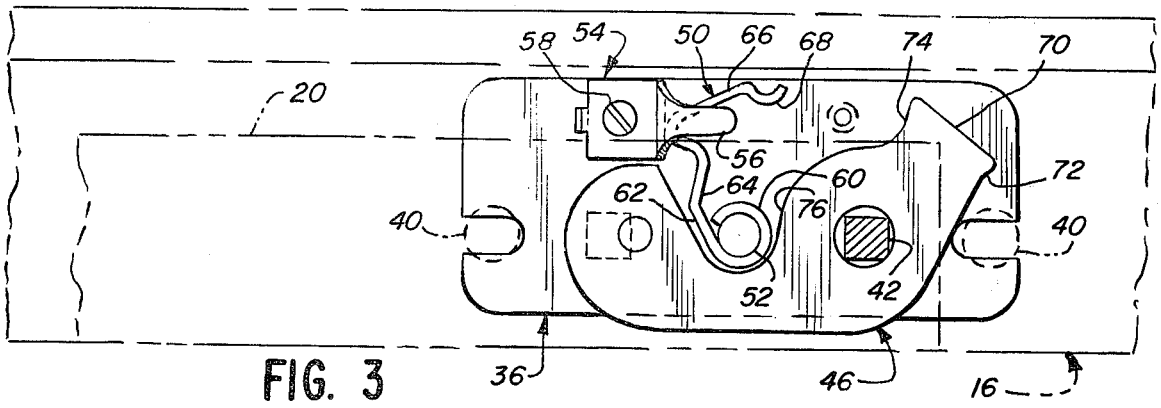
FIG. 3
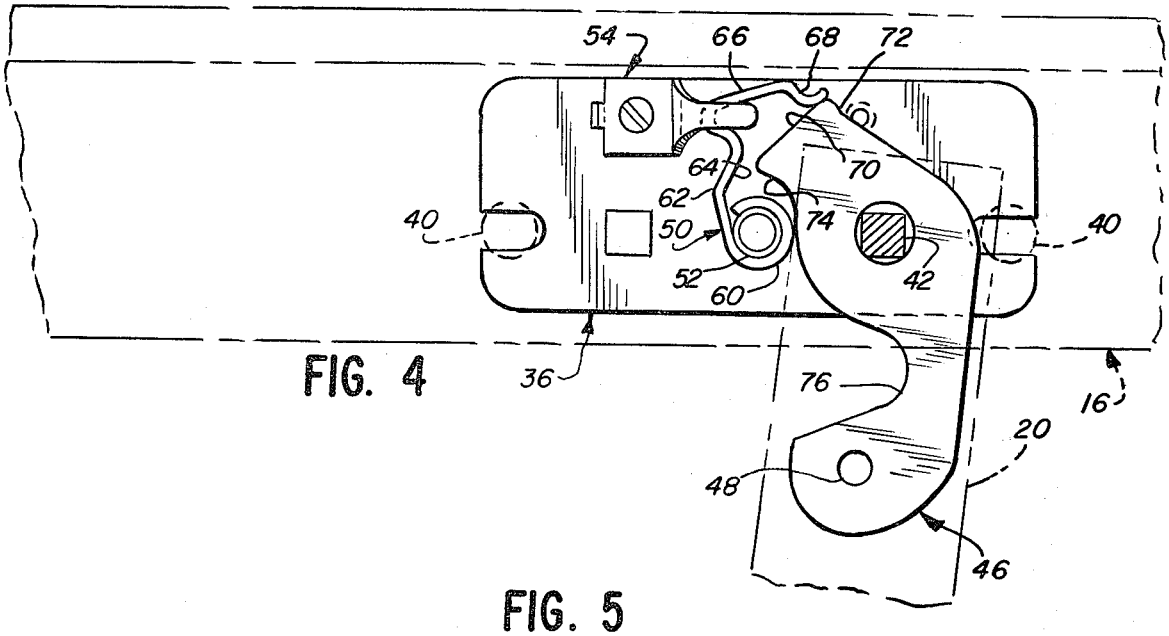
FIG. 4
FIG. 5
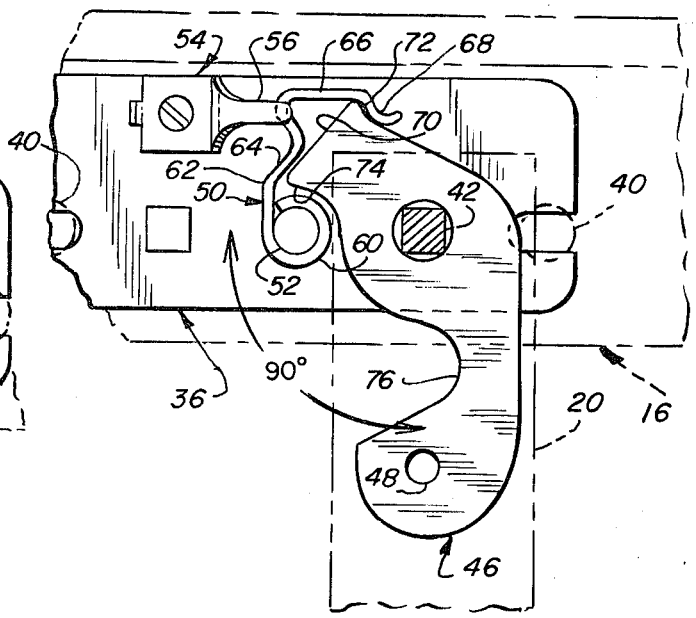
FIG. 5A
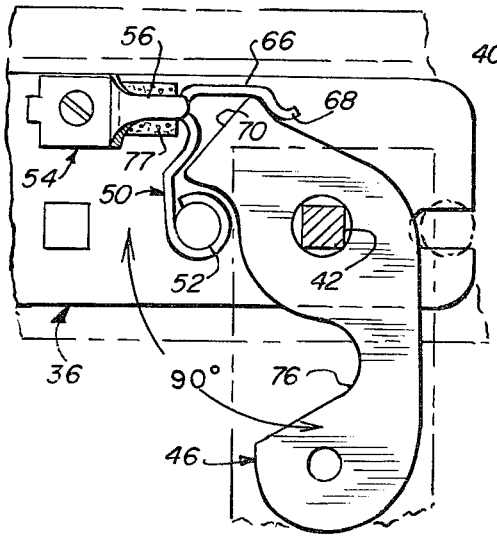

HOLD-OPEN MECHANISM FOR REFRIGERATED DISPLAY CABINET HAVING COOPERATING SPRING AND LOBED PLATE

TECHNICAL FIELD OF THE INVENTION

The present invention relates generally to commercial refrigerator door assemblies and more particularly to a releasable hold-open mechanism for maintaining the door in an open position.

BACKGROUND OF THE INVENTION

Refrigerated display cabinets are widely used for retail sale of refrigerated and frozen food goods. A typical door construction includes a hingedly mounted door having a plurality of spaced, insulating glass panels. U.S. Pat. Nos. 2,987,782 and 3,131,421, to Kurowski illustrate typical constructions for insulated door structures of this description.

In order to minimize the load on the refrigeration unit of the refrigerated display cabinet, and to effect sealing of the door with the door frame of the display case, door arrangements as described above are typically provided with a spring-loading arrangement so that each door of the display cabinet is self-closing. However, there are certain times when it is desired for a door of the display cabinet to be maintained in an open position, such as during stocking of the cabinet or maintenance. Thus, one desirable feature for the door assemblies of the display cabinet is a so-called hold-open mechanism so that the door may be selectively maintained in an open position.

One typical type of hold-open mechanism for display cabinet door assemblies includes a plate or other abutment member movably mounted on the door frame of the display cabinet. The hold-open plate is adapted to engage a portion of the hinged door when the door is in an open position and after the plate is suitably manipulated, thus acting to maintain the door in an open position. The door may then be closed again only by first manipulating the plate so that it is moved out of engagement with the door.

One problem with hold-open mechanisms of this description relates to their non-yielding, positive engagement of the hinged door. Specifically, when the hold-open plate is in the hold-open position and positively engages the door, attempts to close the door or otherwise move it from the open position may cause damage to both the door, the hold-open mechanism and/or the door frame. For example, damage to the door may include breakage of any glass panel and/or distortion of the door sufficient to require replacement. Naturally, occurrences of this nature are extremely undesirable.

Thus, a hold-open mechanism for a spring-loaded swinging door of a refrigerator display cabinet which may be easily used so as to maintain the door in an open position, yet which is releasable, i.e., may be overridden without causing damage, when the door is moved from the open position would be a desirable and practical improvement for refrigerated display cabinets having hingedly mounted door structures.

SUMMARY OF THE INVENTION

In accordance with the present invention, a door hold-open mechanism is provided for a door of a refrigerated display cabinet hingedly mounted to a door frame for swinging movement between closed and open positions. The door is typically provided with spring means for urging the door toward the closed position as is well known, so that the door is self-closing and is urged into sealing engagement with the door frame.

The hold-open mechanism of the present invention includes a stop plate affixed to the door and movable therewith. The stop plate includes a lobe portion, and is adapted to cooperate with a stop carried by a door hinge plate mounted on the door frame so that opening movement of the door is limited (usually to approximately 90 degrees).

The hold-open mechanism further includes a hold-open spring mounted on the door frame and engageable with the lobe portion of the stop plate. In the preferred embodiment, the hold-open spring is mounted on the stop pin carried by one of the hinge plates mounted to the door frame.

The hold-open spring has a generally hook-shaped configuration, and in the preferred embodiment it is pivotally mounted on the stop pin of the hinge plate. The free end portion of the spring is offset, and this end portion is adapted to engage and cooperate with the lobe portion of the stop plate so as to releasably retain the stop plate (and thus the door) when the door is in the open position.

The nature of the pivotal mounting of the hold-open spring to the stop pin of the hinge plate permits the spring to be manually moved from a first inactive to a second hold-open position. In the first position the spring does not reactively engage and retain the plate carried by the door, thus permitting the door to operate in a normal fashion. In the second position, the spring is adapted to releasably engage and retain the plate so that the door is maintained in the open position, yet functions in a self-releasing fashion to automatically disengage when the door is moved from the open position with sufficient force.

In a modification of the preferred embodiment, the hold-open spring is mounted on the stop pin of the hinge plate, and is pinned thereto. In this embodiment, movement of the door of the display cabinet to its fully open position automatically moves the stop plate carried by the door into engagement with the hold-open spring so that the stop plate is releasably retained thereby and the door is maintained in its open position. Movement of the door from the open position with sufficient force disengages the stop plate from the hold-open spring so that the door again may swing in a normal fashion.

As will be appreciated from the following detailed description, the hold-open mechanism of the present invention may be easily fabricated and adapted to hinged door assemblies having a variety of configurations.

Numerous other advantages and features of the present invention will become readily apparent from the following detailed description of the invention and embodiment thereof, from the claims and from the accompanying drawingx in which like numerals are employed to designate like parts throughout the same.

BRIEF DESCRIPTION OF THE DRAWINGS

FIGS. 3–5 illustrate the hold-open mechanism of FIG. 2 during swinging movement of the door of the display cabinet illustrated in FIG. 1;

FIG. 5*a* illustrates a modification of the hold-open mechanism of FIG. 2;

DETAILED DESCRIPTION

Figure 1:
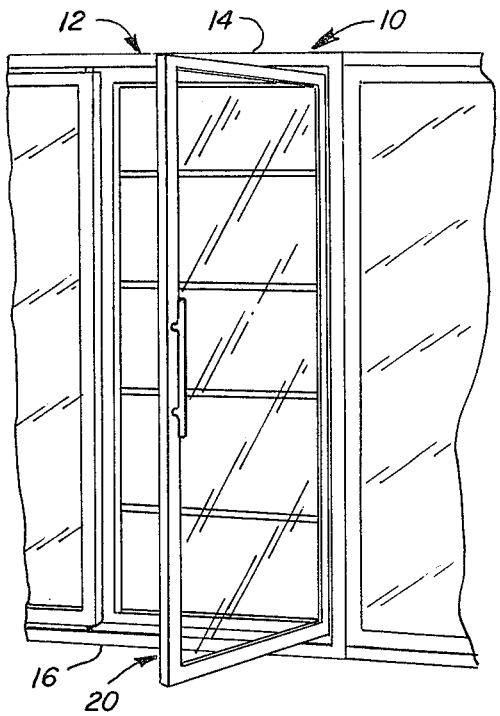
FIG. 1 is a partial perspective view of a refrigerated display cabinet.

While the present invention is susceptible to embodiment in different forms, there is shown in the drawings and will hereinafter be described a preferred embodiment and alternate embodiments thereof with the understanding that the present disclosure is to be considered as an exemplification of the principles of the present invention and is not intended to limit the invention to the embodiments illustrated.

With reference now to FIG. 1, there is illustrated a refrigerated display cabinet 10 such as the type found in supermarkets and the like for storage and display of refrigerated and frozen food items. While the hold-open mechanism of the present invention has been found to be particularly suited for use on display cabinets of this type, it will be appreciated that the invention is equally suited to a wide variety of applications.

The display cabinet 10 typically includes a generally rectangular metal frame 12 including spaced upper and lower door frame members 14, and a plurality of laterally spaced, vertically extending frame columns or mullions 18. Door frame 12 supports one or more insulated glass doors 20 in side-by-side arrangement, each door 20 including a generally rectangular glass door frame 22 which supports a plurality of spaced, insulating glass panels 24.

Figure 2:
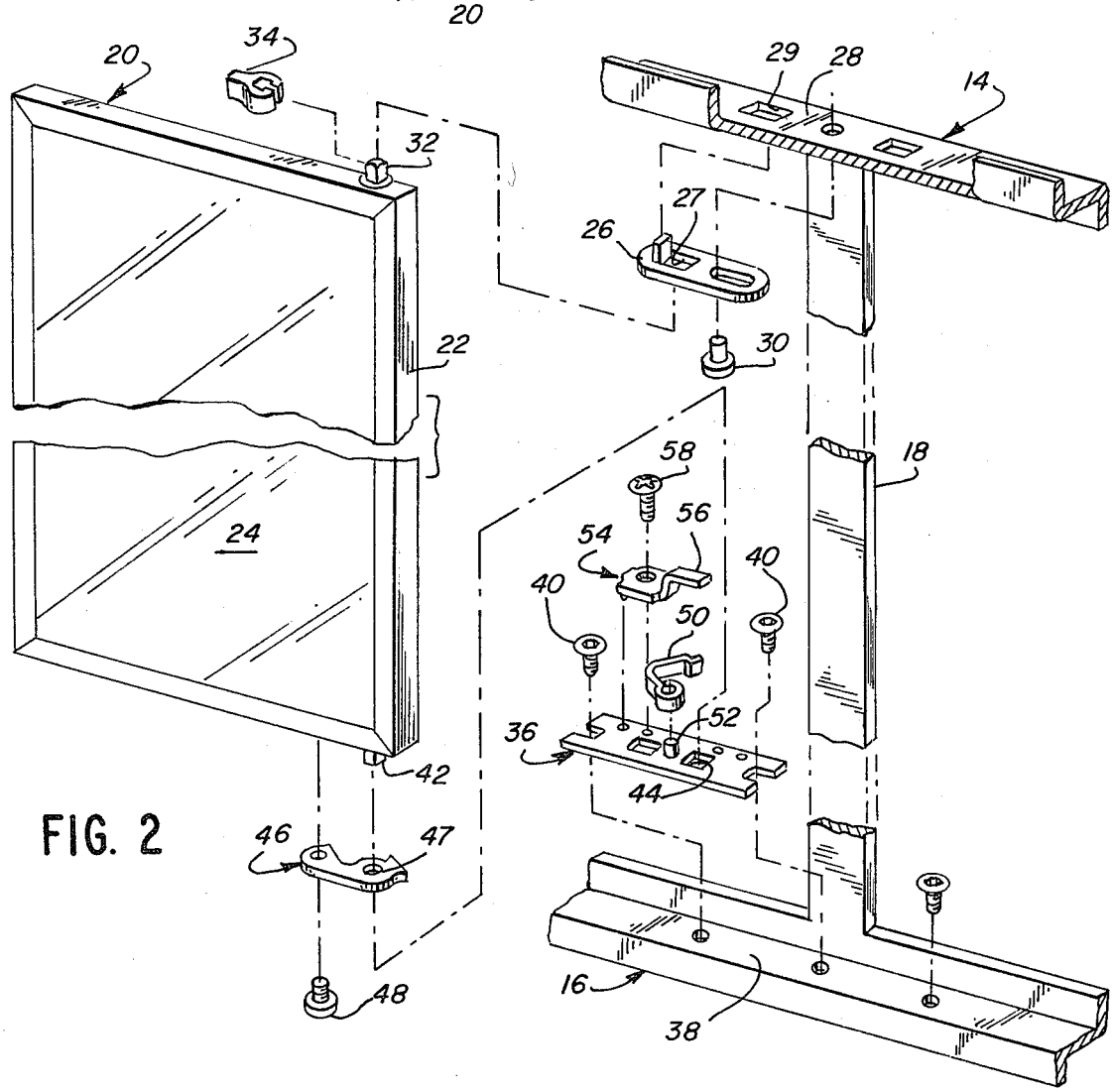
FIG. 2 is an exploded perspective view of the door mounting arrangement of the display cabinet of FIG. 1 including the hold-open mechanism of the present invention.

As best shown in FIG. 2, each glass door 20 is hingedly mounted for swinging movement with respect to door frame 12 by upper and lower hinge assemblies. The upper hinge assembly includes an upper hinge plate 26 which is adapted to be connected to a web portion 28 of upper frame member 14 by a mechanical fastener 30. An upper hinge pin 32 projecting upwardly of glass door frame 22 is adapted to fit within corresponding cut-out portions 27 and 29 in hinge plate 26 and web portion 28 for support of door 20. A hinge pin lock 34 is adapted to fit about upper hinge pin 32 for maintaining door 20 in position as is well known.

Door 20 is further supported on door frame 12 by a lower hinge assembly which includes a lower hinge plate 36. Lower hinge plate 36 is adapted to be mounted on a web portion 38 of lower frame member 16 by a mechanical fastener 40. A lower hinge pin 42 extending downwardly from the door frame 22 is adapted to fit within one of cut-outs 44 defined by lower hinge plate 36.

Installation of door 20 to door frame 12 is accomplished by respectively mounting upper and lower hinge plates 26 and 36 to upper and lower frame members 14 and 16. The upper and lower hinge plates shown in the drawing are of the type which may be shifted or adjusted with respect to the frame member upon which they are mounted so that the swinging axis of door 20 may be adjusted for proper alignment, although other door mounting arrangements may be used. After the hinge plates are in place, door 20 may be lifted into door frame 12 such that upper hinge pin 32 fits into cut-outs 27 and 29 respectively defined by upper hinge plate 26 and web portion 28 of upper frame member 14. As the door 20 is lifted into the frame, lower hinge pin 42 is raised sufficiently to clear lower hinge plate 36, and door 20 may be swung inwardly of the door frame 12. After door 20 is swung inwardly, the entire door 20 may be lowered so that lower hinge pin 42 fits within one of the cut-outs 44 defined by lower hinge plate 36, and door 22 is now supported within door frame 12. Hinge pin lock 34 may now be fitted about upper hinge pin 32 so that inadvertent lifting of the door out of the frame is prevented.

As noted, door 20 incorporates a self-closing mechanism so that it is urged toward a closed position with respect to the door frame 12, and is urged into sealing engagement with the frame. Such self-closing mechanisms are well known. For example, a self-closing action is typically provided by a spring-loading mechanism associated with one or both of upper and lower hinge pins 32 and 42.

In accordance with the present invention, a stop plate 46 is provided on door 20. As shown, stop plate 46 includes a cut-out 47 so that it fits about lower hinge pin 42, and is suitably affixed to door 20 by a mechanical fastener 48. The exact configuration and function of stop plate 46 will be further described.

The hold-open mechanism of the present invention further includes a hold-open spring 50 movably mounted on a spring pin 52 projecting upwardly from lower hinge plate 36. Hold-open spring 50 is maintained in position on spring pin 52 by a spring guard 54 mounted on hinge plate 36 by mechanical fastener 58. Spring guard 54 includes an outwardly projecting finger portion 56 which is disposed generally adjacent to and above hold-open spring 50.

With reference now to FIGS. 3–5, the exact configuration of the components of the hold-open mechanism of the present invention will be described. As shown, hold-open spring 50, which may be suitably fabricated from heat treated spring steel or other suitably resilient material, has a generally hook-shaped configuration and includes several distinct portions. Specifically, spring 50 includes a mounting end portion 60 which is shaped so that it fits about spring pin 52. Spring 50 further includes a first leg 62, which includes an offset abutment portion 64, and a second leg 66 disposed at an angle to the first leg 62. The second leg 66 terminates in an offset free end portion 68 having a generally S-shaped configuration.

While spring 50 is preferably fabricated from a single piece of material, it will be appreciated that a similar member could be provided having the requisite resiliency such as by joining substantially rigid leg portions by a resilient interconnection.

With further reference to FIGS. 3–5, stop plate 46 affixed to door 20 includes a lobe portion 70 at one end thereof spaced from the swinging axis of the door. The lobe portion 70 defines a pair of shoulders 72 and 74 on opposite sides thereof. A cut-out portion 76 defined by the plate accommodates movement of the door without interference of the plate with other portions of the mechanism.

Normal swinging movement of door 20 is provided with spring 50 in the position illustrated in FIG. 3. As shown, door 20 (shown in phantom) is in its fully closed position. Cut-out portion 76 of stop plate 46 is defined such that the stop plate clears spring pin 52 on lower hinge plate 36 so that the spring pin is disposed within the cut-out portion. Hold-open spring 50 is illustrated in a first inactive position for normal swinging movement of the door 20 without hold-open action.

Swinging movement of door 20 from the position illustrated in FIG. 3 causes rotation of stop plate 46 therewith. As the door is moved toward its fully opened position, shoulder 74 of the stop plate moves toward spring pin 52 on hinge plate 36. As the door is moved to its fully open position, shoulder 74 engages and abuts spring pin 52. (As shown, shoulder 74 actually abuts end portion 60 of hold-open spring 50 mounted on spring pin 52). This cooperative interengagement of the stop plate 46 with the spring pin 52 prevents further opening movement of the door 20. Notably, the position of hold-open spring 50 shown in FIG. 3 is such that lobe portion 70 of the stop plate may clear the spring 50 without reactive engagement therewith, thus permitting the door to swing in a normal fashion.

When the open door is released, movement of the door 20 from the fully opened position is provided by the spring-loading mechanism associated therewith as is known. The lack of reactive engagement between stop plate 46 and hold-open spring 50 permits the door 20 to close in a normal fashion.

When it is desired that door 20 be maintained in an open position, such as during stocking of the shelves of the refrigerated display cabinet 10, the hold-open mechanism of the present invention provides this action in a simple and straightforward fashion. Stock personnel would first move door 20 toward its fully open position, as illustrated in FIGS. 4 and 5. When the door 20 is in this position, hold-open spring 50 may be easily manipulated so that it is moved from the position shown in FIG. 3 to the right, as shown in FIG. 4. As this is done, the free end portion 68 of hold-open spring 50 is urged over lobe portion 70 of stop plate 46 such that free end portion 68 engages shoulder 72 of the stop plate 46.

FIG. 5 illustrates hold-open spring 50 after having been so moved with respect to spring pin 52 such that free end portion 68 of the spring is in engagement with shoulder 72 of the stop plate 46. In this position of the hold-open spring, its reactive engagement with stop plate 46 releasably retains the stop plate so that door 20 is releasably maintained in its open position. With the door 20 maintained in its opened position, stock personnel may easily stock the shelves of refrigerator display cabinet 10.

When stocking of the shelves of the display cabinet is completed and it is no longer desired to maintain door 20 in its open position, the hold-open mechanism of the present invention provides for essentially automatic disengagement of stop plate 46 from hold-open spring 50 so that door 20 is again biased toward its closed position by the self-closing mechanism. Specifically, exertion of sufficient force on door 20, such as by manually pushing the door, results in stop plate 46 disengaging from hold-open spring 50. This action is accomodated by reactive engagement and abutment of the portion of lobe portion 70 which defines shoulder 74 with offset abutment portion 64 of spring 50. This engagement displaces the spring such that free end portion 68 is urged out of engagement with shoulder portion 72. When free end portion 68 of the hold-open spring has been disengaged from shoulder 72 of the top plate and clears lobe portion 70, the self-closing action of door 20 will again urge the door toward its closed position, and the door may again swing in a normal fashion.

Release of the hold-open mechanism is provided in an extremely simple fashion. The self-releasing nature of the releasable engagement of stop plate 46 with hold-open spring 50 assures that inadvertent closing movement of door 20 while the hold-open mechanism is engaged will not result in damage to the mechanism or the door. For a typical installation, the hold-open mechanism is designed to resist closing torque on the door on the order of 100 foot-pounds before disengagement of spring 50 and plate 46.

With reference to FIG. 5*a*, a modification of the above-described hold-open mechanism is shown. In this modification, a biasing spring 77 is disposed in a captive fashion between spring guard 54 and hold-open spring 50. In this way, spring 50 is biased and urged from its first inactive position toward its second active position for reactive engagement with stop plate 46. Biasing spring 77 may comprise any suitable resilient material, with a small piece of elastomeric surgical tubing having proved durable and effective.

Operation of the hold-open mechanism as shown in FIG. 5*a* with spring 77 in place is similar to the operation as described above, except that hold-open spring 50 is constantly urged toward its reactive disposition. Thus, during opening movement of door 20, end portion 68 of spring 50 engages lobe portion 70 of stop plate 46. As the door is moved to its fully opened position, spring 77 automatically biases spring 50 so that end portion 68 "rides up" the surface of lobe portion 70 until it clears the lobe portion and engages shoulder 72. The door is then maintained by spring 50 in its opened position as desired. In this embodiment, the hold-open mechanism operates to maintain door 20 fully opened whenever the door is moved into that position, and thus manipulation of spring 50 as described with respect to the embodiment of FIGS. 2–5 is unnecessary, the hold-open mechanism being self-engaging.

Release of the hold-open mechanism as shown in FIG. 5*a* is essentially the same as above. Movement of door 20 urges stop plate 46 out of engagement with spring 50, the reactive engagement of the lobe portion 70 defining shoulder 74 with abutment portion 64 of spring 50 acting against biasing spring 77 to disengage end portion 68 of spring 50 from shoulder 72 of the stop plate. When portion 68 is disengaged from shoulder 72, the self-closing mechanism of the door again moves it to its closed position.

Figure 6:
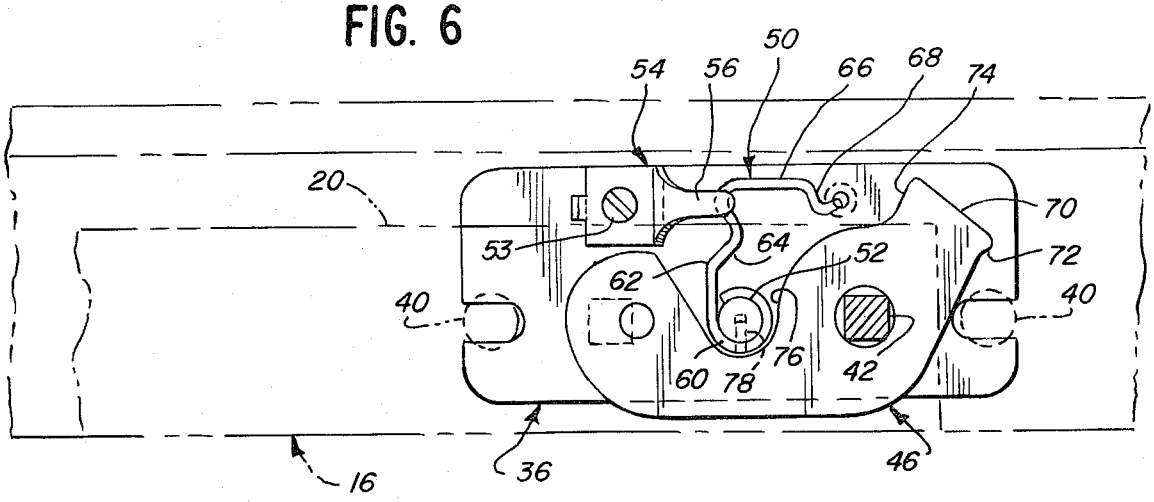
FIGS. 6–8 are plan views of an alternate embodiment of the hold-open mechanism of the present invention during swinging movement of the door of the display cabinet of FIG. 1.
Figure 7:
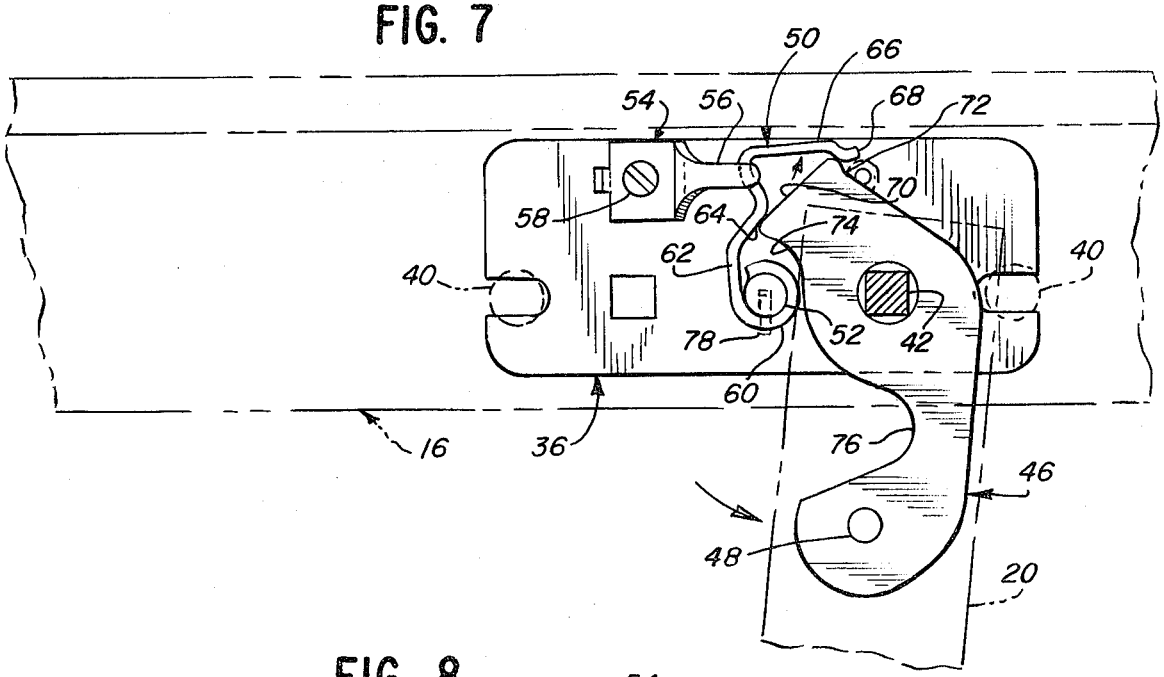
Figure 8:
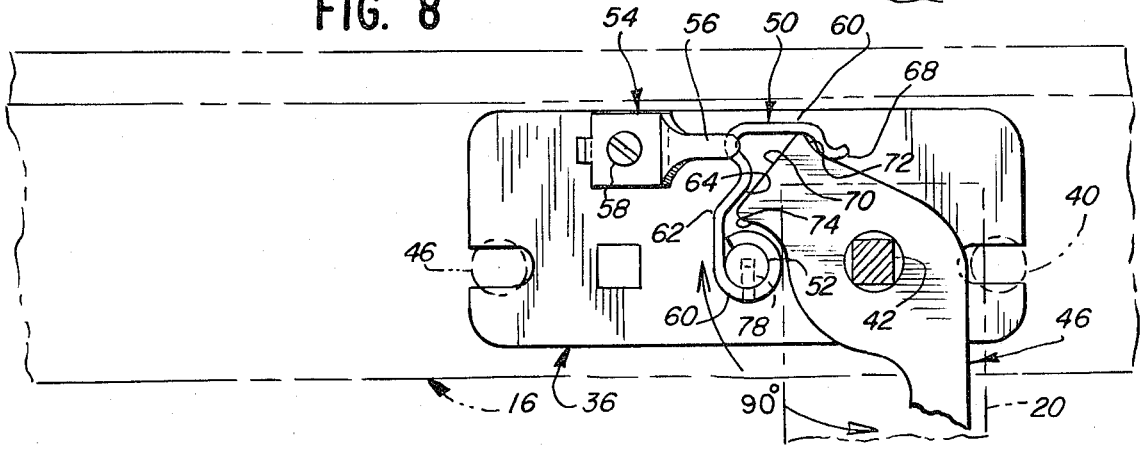

Referring now to FIGS. 6–8, a further modified version of the hold-open mechanism of the present invention is shown. The arrangement shown in these figures is substantially the same as the hold-open mechanism illustrated in FIGS. 3–5. However, one significant difference is illustrated in that hold-open spring 50 of the mechanism is shown fixedly attached to spring pin 52 of lower hinge plate 36 by a pin 78 or other suitable mechanical fastener means. It will be appreciated that the inclusion of pin 78 prevents movement of spring 52 between a first inactive position and a second engaging, hold-open position, as previously described. This modification provides a slightly different working action for the hold-open mechanism.

As shown in FIG. 6, door 20 (shown in phantom) is in its closed position. As door 20 is moved toward its open position, lobe portion 70 of stop plate 46 is moved toward free end portion 68 of hold-open spring 50. As lobe portion 70 moves into engagement with the free end portion 68, the configuration of end portion 68 causes it to engage and cam against lobe portion 70 of plate 46 so that the spring "rides up" lobe portion 70.

Continuing movement of door 20 toward its fully opened position results in free end portion 68 of hold-open spring 50 moving across the surface of lobe portion 70 of plate 46 until portion 68 moves toward engagement with shoulder 72 of plate 46. This action is illustrated in FIGS. 6 and 7 wherein hold-open spring 50 is shown releasably engaging and retaining stop plate 46 (and thus door 20) as door 20 is moved to its fully opened position. Thus, hold-open spring 50 automatically cooperates with stop plate 46 so that door 20 is maintained in its fully open position whenever moved to that position. It will be appreciated that this action is similar to the action of the modified hold-open mechanism illustrated in FIG. 5*a*.

Self-releasing disengagement of the hold-open mechanism of this embodiment is provided as described above. Exertion of sufficient force on door 20 results in free end portion 68 of hold-open spring 50 slipping off of and disengaging from shoulder 72 of stop plate 46. After stop plate 46 is disengaged from the hold-open spring 50, the self-closing action of door 20 again moves the door toward its closed position as the door swings closed in a normal fashion.

Thus, a novel and simple hold-open mechanism is disclosed for hingedly mounted door arrangements which is particularly suited for use with self-closing doors of refrigerated display cabinets.

The hold-open mechanism incorporating the present invention operates to permit closing of the door by overriding or self-release, thus preventing damange to the door or door frame even when the hold-open mechanism is engaged. The releasable hold-open mechanism may be configured for manual or automatic engagement or operation without detracting from its releasing characteristics.

From the foregoing it will be appreciated that numerous variations and modifications may be effected without departing from the true spirit and scope of the novel concept of the present invention. It will be understood that no limitations with respect to the specific embodiments illustrated herein is intended or should be inferred. It is, of course, intended to cover by the appended claims all such modifications as fall within the scope of the claims.

What is claimed is:

1. A door hold-open mechanism for a door hingedly mounted to a door frame for swinging movement between closed and opened positions, said mechanism comprising:

plate means affixed to said door and movable therewith and having first and second shoulders, and spring means mounted on said frame adapted to engage with said plate means when said door is in said opened position and adapted to disengage said plate means when said door is moved from said opened position, whereby said door is adapted to be releasably maintained in said opened position, said spring means comprising a spring including a first end portion mounted on said frame, a second free end portion adapted to releasably engage said first shoulder on said plate means, and an intermediate portion spaced from said second end portion and abutting said second shoulder on said plate means when said door is moved from said opened position toward said closed position to displace said spring means and thereby urge said second end portion out of engagement with said first shoulder on said plate means.

2. A door hold-open mechanism in accordance with claim 1, wherein said spring means is fixedly mounted on said frame.

3. A door hold-open mechanism in accordance with claim 1, wherein said spring means is pivotally mounted on said frame for movement between a first inactive position and a second hold-open position wherein said spring means engages said plate means when said door is in said opened position.

4. A door hold-open mechanism in accordance with claim 3, and means for biasing said spring means toward said second position for automatic engagement of said spring means with said plate means when said door is moved into said opened position.

5. A door hold-open mechanism for a door hingedly mounted to a door frame for swinging movement between closed and opened positions, said mechanism comprising:

plate means affixed to said door and movable therewith, spring means mounted on said frame adapted to engage said plate means when said door is in said opened position and adapted to disengage said plate means when said door is moved from said opened position, whereby said door is adapted to be releasably maintained in said opened position, and a hinge plate mountable on said frame including an upstanding pin upon which said spring means is mounted, said plate means cooperating with said pin to limit swinging movement of said door toward said opened position.

6. A door hold-open mechanism in accordance with claim 5, wherein said plate means defines a cut-out portion within which said upstanding pin is disposed when said door is in said closed position.

7. A door hold-open mechanism in accordance with claim 5, and a spring guard mounted on said hinge plate including a finger disposed generally adjacent said spring means for retaining said spring means in place.

8. A door hold-open mechanism for a door hingedly mounted to a door frame for swinging movement about an axis between closed and opened positions, said mechanism comprising:

plate means mounted on said door and movable therewith, said plate means including a lobe portion spaced from the swinging axis of said door and having first and second shoulders, and spring means mounted on a hinge plate mounted on said frame, said spring means including a generally hook-shaped spring having one end portion mounted on said hinge plate, a free end portion engageable with said first shoulder of said lobe portion of said plate means, and an intermediate portion spaced from said free end portion, said free end portion of said spring means releasably engaging and retaining said lobe portion of said plate means when said door is in said opened position for maintaining said door in said opened position, said free end portion of said spring means releasing and disengaging said plate means in response to abutment therewith by said second shoulder of said lobe portion against said intermediate portion of said spring means when said door is moved from said opened position toward said closed position whereby said free end portion is then disengaged from said first shoulder.

* * * * *